US005605451A

United States Patent [19]

Saitoh

[11] Patent Number: 5,605,451

[45] Date of Patent: Feb. 25, 1997

[54] FLUID APPARATUS OF AN INTERNAL GEAR TYPE HAVING DEFINED TOOTH PROFILES

[75] Inventor: Masaoki Saitoh, Hiki-gun, Japan

[73] Assignee: Tokyo Sintered Metal Company Limited, Tokyo, Japan

[21] Appl. No.: 612,312

[22] Filed: Mar. 7, 1996

[30] Foreign Application Priority Data

Mar. 14, 1995 [JP] Japan ..... 7-054297

[51] Int. Cl.[6] ..... F01C 1/10; F03C 2/08; F04C 2/10

[52] U.S. Cl. ..... 418/150; 418/170

[58] Field of Search ..... 418/150, 169, 418/170

[56] References Cited

U.S. PATENT DOCUMENTS

| | | | |
|---|---|---|---|
| 3,491,698 | 1/1970 | Truninger | 418/170 |
| 3,907,470 | 9/1975 | Harle et al. | 418/170 |
| 4,155,686 | 5/1979 | Eisenmann et al. | 418/170 |
| 4,386,892 | 6/1983 | Stich et al. | 418/170 |
| 5,163,826 | 11/1992 | Cozens | 418/170 |
| 5,413,470 | 5/1995 | Eisenmann | 418/170 |

FOREIGN PATENT DOCUMENTS

| | | | |
|---|---|---|---|
| 295169 | 11/1967 | Australia | 418/169 |

*Primary Examiner*—John J. Vrablik
*Attorney, Agent, or Firm*—Young & Thompson

[57] ABSTRACT

A fluid apparatus of an internal gear type comprising an internal gear 3 rotatively mounted in a housing 1, an external gear 5 meshing with said internal gear 3, and a crescent partition piece disposed between the both gears, each tooth profile of said both gears 3 and 5 being defined by a line equidistant from an inner cycloid described by a rolling circle, the diameter of which is equal to a radius of the intermeshing pitch circle of the internal gear, whereby the load applied to the tooth surfaces between the meshing internal gear and external gear and thus the tooth-contact stress can be reduced, and wear of tooth surfaces and generating noise can also be minimized.

1 Claim, 3 Drawing Sheets

FLUID APPARATUS OF AN INTERNAL GEAR TYPE HAVING DEFINED TOOTH PROFILES

BACKGROUND OF THE INVENTION

1. Field of the Invention

The present invention relates to a fluid apparatus of an internal gear type for operating as a fluid pump or a fluid motor, said apparatus comprising; an internally toothed gear rotatively mounted within a housing, an externally toothed gear disposed within said internally toothed gear so as to mesh therewith, and a crescent-shaped partition piece disposed within the housing between both gears.

2. Description of Related Art

FIG. 1 illustrates a front view of an internal gear pump of the present invention as an embodiment of a fluid apparatus in which a cover is removed. An internal gear 3 having internal teeth 2 is rotatively mounted in a housing 1. An external gear 5 having external teeth 4 meshed with the internal teeth 2 is fixed to a driving shaft rotatively supported in the housing 1 and is disposed eccentric to the internal gear 3. A crescent-shaped partition piece 6 is disposed at a space between both gears. The housing 1 is provided with an outlet port 7 and an inlet port 8 at positions before and after the meshing point of both gears, respectively.

With this arrangement the external gear 5 driven by rotation of the driving shaft causes the internal gear 3 to rotate whereby a bite gap at the side of the outlet port between the internal teeth 2 and the external gear 4 is gradually reduced so that the fluid existing between the gears is discharged from the outlet port 7 to the outside of the housing while the gap at the side of the inlet port is gradually increased so that fluid is absorbed into the gap from the inlet port 8 according to a negative pressure built-up in the gap.

In such an internal gear pump the following matters are generally known as a basic design technique of both gears 3 and 5.

Firstly, the meshing tooth profile of both gears of such an internal gear pump is usually determined only by their meshing relation so that once the tooth profile of one of the gears is determined, the tooth profile of the other gear is defined in only one meaning manner and in such a manner that the both gears mesh in rolling contact without slippage along the intermeshing pitch circles, and a meshing rate is larger than 1. Such an arrangement realizes smooth rotation of the gears 3 and 5, and prevents wear of tooth surfaces and noise.

Secondly, when both gears 3 and 5 mesh with each other as shown FIG. 2, the volume of a confined space 11 between two meshing points 9 and 10 of the teeth 2 and 4 is reduced to a minimum as shown FIG. 2 during rotation of the gears 3 and 5 before the volume of the space is increased. Therefore, the adjacent edges 7*a* and 8*a* of the outlet port 7 and the inlet port 8 are usually positioned nearby the meshing points 9 and 10, respectively, which make the volume of the confined space 11 minimum so as to prevent pulsation of the fluid discharging pressure or cavitation upon absorption.

On the other hand, addition to the matter that the meshing rate is larger than 1, the tooth profile is generally so determined that both meshing points 9 and 10 are involved in the tooth surface at the rotational position where the volume of the confined space 11 becomes minimum, and thus effective tooth surfaces for meshing of such gears 3 and 5 are present in a higher height to the inside or the outside from the respective intermeshing pitch circles 12 and 13, respectively.

Furthermore in such an internal gear pump having a crescent-shaped partition piece, the relative curvature between the two tooth surfaces and operating pressure angle are so taken into consideration that they may be as small as possible whereby the load applied to the tooth surfaces can be reduced and wear of the tooth surfaces and bearings can be prevented.

By the way, such a consideration for the relative curvature and operating pressure angle in such an internal gear pump is very important especially near the end of meshing of both gears and when the distal end of the tooth of the external gear and the proximal end of the tooth of the internal gear are meshed with each other. That is because, as diagrammatically shown in FIG. 3, the torque required for rotating the internal gear 3 against pressures P1 and P2 applied to the internal tooth 2 is not constant over the whole meshing region between the internal tooth 2 and the external tooth 4, but the torque can be increased as the biting point 14 is moved from the distal end of the internal tooth 2 of the internal gear 3 to the proximal end thereof, and the load applied to the tooth surfaces might be maximum when both gears 3 and 5 mesh with each other at the distal end of the external tooth 4 and the proximal end of the internal tooth 2.

Furthermore, in such an internal gear pump by reducing the number of the teeth and difference in the number of the teeth of both gears 3 and 5 and by enlarging the tooth depth thereof, discharging volume can be large at the same outline size, and an outline size required for obtaining a desired output can be small. However, in such selection interference of both teeth 2 and 4 or so-called trochoid interference could occur when the external tooth 4 leaves the tooth groove of the internal gear after ending to mesh between both gears 3 and 5.

As the tooth profile of teeth 2 and 4 of the internal gear 3 and external gear 4 of such a kind of an internal gear pump, an involute profile, a profile along a line equidistant from an inner cycloid and an arced profile of internal gear teeth 2 have been widely used.

However, as such prior art pumps are compared with the above mentioned basic matters of design, in case of the involute profile the path of contact is straight, and the operating pressure angle is constant over the whole meshing region, the operating pressure angle upon meshing between the distal end of the external tooth 4 and the proximal end of the internal tooth 2 is larger than in other tooth profiles, so that the load applied to the tooth surfaces may be larger, and the load applied to the bearings may also be larger, by which trochoid interference can easily occur. Therefore, it has a problem that the outer profile size of the pump is obliged to be large for obtaining a desired discharging output.

On the other hand, the profile along the line equidistant from the inner cycloid and the arced profile as a tooth profile of the internal tooth 2 have not such a problem. This is because in such profiles the path of contact 15 is, as shown in FIG. 2, curved convexly in a radially outward direction so as to entwine around the pitch circles 12 and 13 and at the outside of the pitch circles 12 and 13 the operating pressure angle A upon meshing between the distal end of the external tooth 4 and the proximal end of the internal tooth 2 is relatively small, and also trochoid interference can hardly occur.

However, such prior tooth profiles of the inner cycloid and the trochoid types have a disadvantage that the relative curvature between the meshing tooth surfaces of the distal end of the external tooth 4 and the proximal end of the internal tooth 2 is relatively large so that in spite of merit of small pressure angle A and then reduction of the load applied to the tooth surfaces a relatively large tooth-contact stress can not be avoided.

The line equidistant from the inner cycloid as mentioned above is referred to as lines 19*a*, 19*b* and 19*c*, which as shown in FIG. 4 are spaced away from the respective inner cycloids 18*a*, 18*b* and 18*c* by a predetermined distance, respectively, said inner cycloids having different figures according to the respective size of inscribed circles 17*a*, 17*b* and 17*c* rolling along the intermeshing pitch circle 16, respectively. The inner cycloid is a straight line passing the center of the intermeshing pitch circle 16 and the equidistant line 19*b* is also a straight line parallel to the cycloid when the diameter of the rolling circle is equal to the radius of the intermeshing pitch circle 16. In case the diameters of rolling circles are smaller and larger than the radius of the intermeshing pitch circle 16, respectively, the respective inner cycloids 18*a* and 18*b* and the equidistant lines 19*a* and 19*b* are both curved lines, respectively. In this case the curving directions of the equidistant lines 19*a* and 19*c* are opposite to each other, so that the radius of curvature of the equidistant line 19*a* is smaller than the radius of curvature of the inner cycloid 18*a* by the amount of its equidistance while the radius of curvature of the equidistant line 19*c* is larger than the radius of curvature of the inner cycloid 18*c* by the amount of its equidistance.

Furthermore the radius of curvature of the curved inner cycloids 18*a* and 18*c* become smaller as they approach the intermeshing pitch circle 16, and become zero on the intermeshing pitch circle. Thus the radius of curvature of the curved equidistant line 19*a* is very small at the outside of the intermeshing pitch circle 16 while that of the equidistant line 19*c* is still relatively large even at the outside of the intermeshing pitch circle 16.

As a prior art, internal gear pumps employing the tooth profile of an equidistant line from an inner cycloid are known from Japanese Patent Application Publication Nos. 19767/75 and 1472/88. In the gear pump known from the former publication the tooth profile of its pinion is straight so that the diameter of the rolling circle is equal to the radius of the intermeshing pitch circle of the pinion. In the gear pump known from the latter publication the diameter of rolling circle is equal to the difference between the diameters of the internal gear and its pinion, and its diameter of the rolling circle is smaller than the radius of the intermeshing pitch circle. Thus in both gear pumps the diameter of the rolling circle is smaller than the radius of the intermeshing pitch circle of the internal gear. In the gear pump disclosed in Japanese Patent Application Publication No. 19767/75 the internal gear has an equidistant-line tooth profile from its inner cycloid described by the rolling circle whose diameter is smaller than the radius of the respective intermeshing pitch circle, and in the gear pump disclosed in Japanese Patent Application Publication No. 1472/88 both of the internal gear and pinion have an equidistant-line tooth profile from its inner cycloid, respectively. In the equidistant-line tooth profile the radius of curvature is, as mentioned above, small especially at the outside of the intermeshing pitch circle, so that the relative curvature between the tooth surfaces becomes large and thus the tooth-contact stress becomes also large when the distal end of the pinion and the proximal end of the internal gear mesh with each other.

Further if the diameter of the rolling circle is very small as shown in the pump of Japanese Patent Application Publication No. 1472/88, it would be difficult to make an equidistant-line tooth profile having a sufficient height toward the outside of the intermeshing pitch circle. In such a case by replacing the profile of the proximal end of the internal gear with an arced profile it is possible to make a tall tooth profile toward the outside of the intermeshing pitch circle. However, the tooth profile of the pinion meshed with the arced surface of the internal gear has a convex shape at the distal end thereof as the pinion of a so-called trochoid pump so that when the distal end of the pinion and the proximal end of the internal gear engage with each other, the relative curvature between the tooth surfaces also becomes larger due to meshing of the gear teeth having convex tooth profile of small radius of curvature.

And such a disadvantage is also the case even in an internal gear of an arced tooth profile in which the relative curvature between the meshing tooth surface upon meshing of the distal end of the pinion and the proximal end of the internal gear is relatively large.

The object of the present invention is to provided with a fluid apparatus of an internal gear type which avoids the disadvantages of the prior internal gear pumps as of type of an equidistant-line tooth profile from an inner cycloid and of an arced tooth profile type without losing their advantages, is less worn, less noisy, and more effective.

SUMMARY OF THE INVENTION

In order to achieve the object, the fluid apparatus of an internal gear type of the present invention comprises an internal gear and an external gear, each tooth profile of which is defined by a line equidistant from an inner cycloid described by a rolling circle rolling along intermeshing pitch circles in an inscribed manner, the diameter of the rolling circle being equal to a radius of the intermeshing pitch circle of the internal gear.

As explained in detail, the diameters of the rolling circles 23 and 24 for describing their inner cycloids 21 and 22 are equal to the radius of the radius of the intermeshing pitch circle of the internal gear, the diameter of the rolling circle 24 of the external gear is larger than the radius of its intermeshing pitch circle whereby the tooth profiles defined by the equidistant lines 25 and 26 from their inner cycloids, respectively provide the internal gear with a straight shape and the external gear with a convex shape.

In this apparatus the radius of curvature of the equidistant line 26 contributing to description of the tooth profile of the external gear is larger than that of the inner cycloid 22 by the amount of the equidistance H, so that the external gear can be made to be a larger radius of curvature and a sufficient height toward the outside of the intermeshing pitch circle 13, and the tooth profile has a large radius of curvature at the distal end of the tooth.

On the other hand the tooth profile of the internal gear is a straight shape, so that the relative curvature between the tooth surfaces emerged upon meshing of the distal end of the external tooth and the proximal end of the internal tooth, is small and thus the tooth-contact stress is also small.

Furthermore this apparatus has such inherent advantages of tooth profiles of cycloid and trochoid types as small operating pressure angle upon meshing between the distal end of the external tooth and the proximal end of the internal tooth, and less trochoid interference.

BRIEF DESCRIPTION OF THE DRAWINGS

The preferred embodiment of the present invention will be now described hereinafter referring to the accompanied drawings, wherein.

DETAILED DESCRIPTION OF THE PREFERRED EMBODIMENTS

Figure 1:
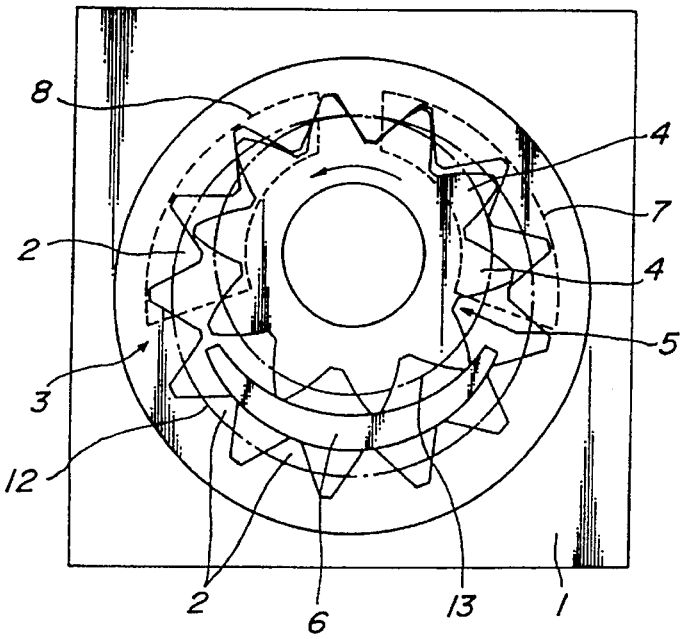
FIG. 1 shows a front view of the present invention in which a cover is removed from its housing.

FIG. 1 is a front view illustrating an internal gear pump according to the present invention, in which a cover is removed, and its basic construction and operation principle are the same as those as mentioned above so that is not further mentioned.

In this embodiment the number of teeth of an internal gear 3 is thirteen, and that of an external gear 5 is ten, so that the ratio of the intermeshing pitch circles 12 and 13 of the internal gear 3 and the external gear 5 is 13:10.

Rolling circles rolling along the respective intermeshing pitch circles 12 and 13 in an inscribed manner, respectively have diameters equal to the radius of the intermeshing pitch circle 12 of the internal gear 3, so that the diameter of the rolling circle 24 for the external gear 5 is larger than the radius of the intermeshing pitch circle 13. The inner cycloid 21 of the internal gear 3 described by rolling of the rolling circles 23 and 24 is a straight line, and the inner cycloid 22 of the external gear 5 is a curved line convex to the left side viewed at the drawing. Thus the equidistant lines 25 and 26 from the respective inner cycloids 21 and 22 are also a straight line and a curved line, respectively. In the embodiment of the drawing, the amount of equidistance H from the respective inner cycloids 21 and 22 is the same at both of gears 3 and 5.

One of the resulting equidistant lines 25 and 26 from the inner cycloids 21 and 22 is determined, the other has a relation as an envelope line of line group described by the one equidistant line when the intermeshing pitch circles 12 and 13 are both rolling without slippage, and in the pump using those equidistant lines 25 and 26 as a tooth profile the tooth profile of the internal gear 3 is a straight shape and that of the external gear 5 is a convex shape.

Figure 2:
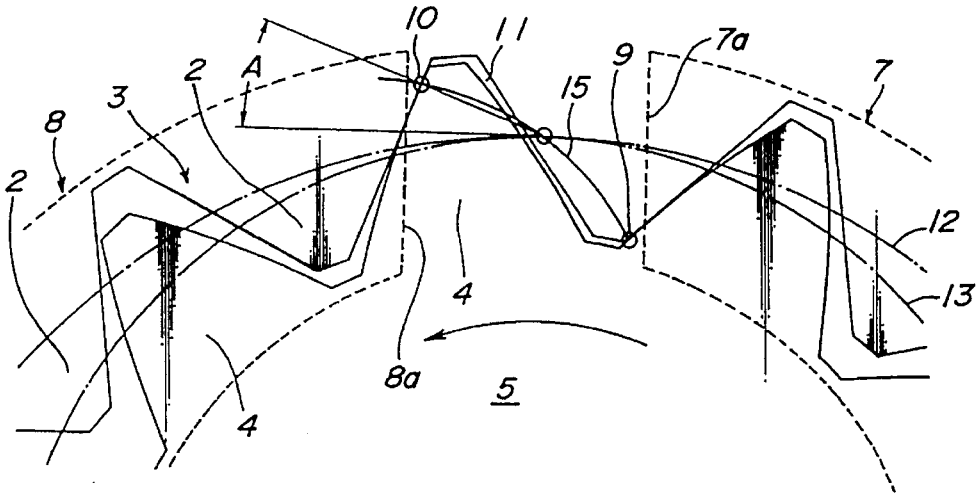
FIG. 2 shows an enlarged view of the main portion of FIG. 1, FIG. 3 diagrammatically shows the situation of the internal gear applied with a discharging pressure, FIG. 4 diagrammatically shows an inner cycloid described by rolling circles of some sizes and their equidistant line thereof.
Figure 3:
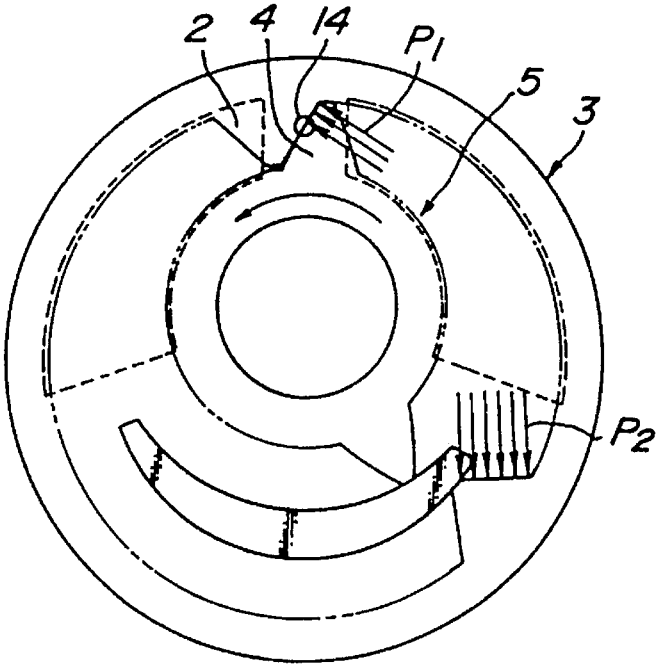
Figure 4:
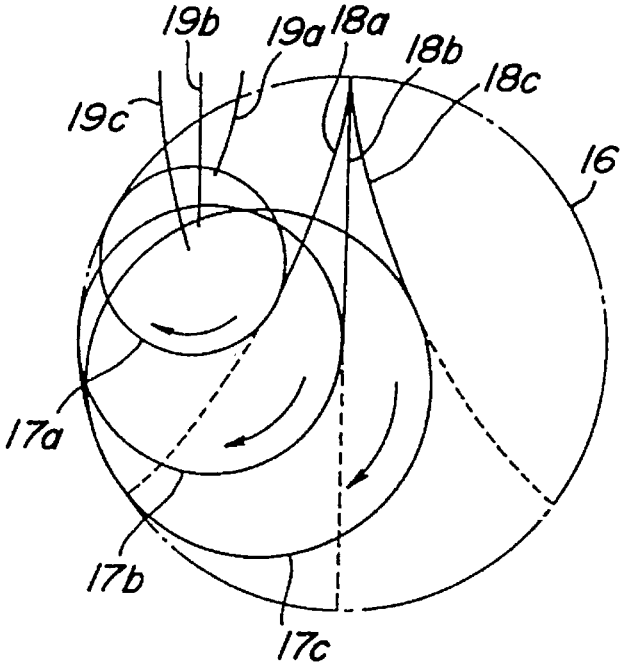
Figure 5:
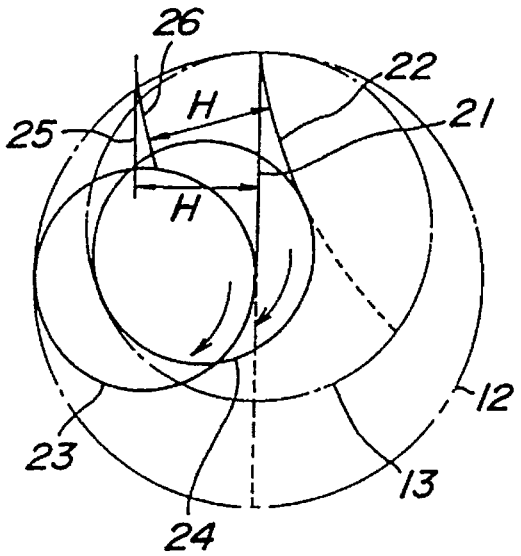
FIG. 5 shows equidistant lines from the inner cycloid of the tooth profiles of the internal tooth and the external tooth, and, FIG. 6 shows a front view of another embodiment like FIG. 1.

Further in this embodiment the amount of the equidistance H from the inner cycloids 21 and 22, and the diameters of the distal end circle and proximal end circle of both gears 3 and 5 should be determined so that the meshing ratio should be more than 1, and the meshing points 9 and 10 should be, as shown in FIG. 2, involved in the tooth profile at the rotational position, in which the volume of the confined space 11 should be minimum.

Furthermore the portion of the tooth profile of the teeth in the position where both gears 3 and 5 do not mesh with each other should be determined by reversing the portion of the tooth profile of the meshing position at a central axis position of the tooth defined by taking the backlash between the both gears and the thickness of each tooth into account.

Figure 6:
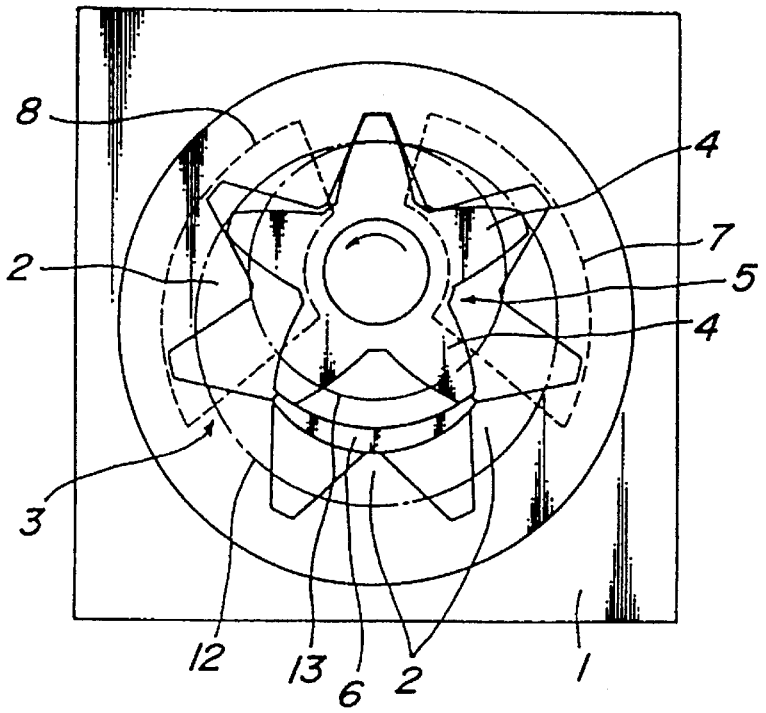

FIG. 6 shows a front view like FIG. 1 of another embodiment of the present invention, in which the tooth profile, etc. are determined in the same manner as those mentioned above, except the number of the teeth of the internal gear 3 is seven and that of the external gear 5 is five.

The shown internal gear pump can be of a large radius of curvature and an enough tall tooth profile and a small relative curvature between the tooth surfaces upon meshing of the distal end of the external tooth 4 and the proximal end of the internal tooth 2, so that the tooth-contact stress should be sufficiently small. Furthermore the operating pressure angle upon meshing situation is so small that the load applied to the tooth surfaces of meshing each other can be effectively reduced, and possibility of trochoid interference can be advantageously eliminated.

As the performance of the shown pump is compared with the trochoid pump of the same outline size having five internal teeth of the internal gear, and four external teeth of the external gear, in the present embodiment the tooth-contact stress upon meshing of the distal end of the external tooth and proximal end of the internal tooth was approximately half as in the trochoid pump of the same outline size, and the pulsation ratio upon discharging was also approximately half as in the same trochoid pump while the discharging amount is equal in both pumps. Furthermore, the pump of the embodiment as shown in the drawings has a crescent partition piece so that it can be considered to have better volume efficiency than the trochoid pump which has no crescent partition piece.

Although it has been described hereinbefore according to the accompanied drawings, the number of the teeth of the internal gear can be changed within the range between 7 and 17, and that of the external gear can be changed within the range reduced by 2–4 from that of the internal gear.

Further although the present invention has been hereinbefore described in connection with a pump, it can be used as a motor.

Thus according to the present invention in which the meshing tooth surfaces between the internal and the external gears is determined by a line equidistant from an inner cycloid described by a rolling circle, the diameter of which is equal to a radius of the intermeshing pitch circle of the internal gear, can sufficiently reduce the tooth-contact stress while entire outline size can be small with the same discharging amount.

Further according to the present invention, though the prior internal gear was difficult to manufacture due to its precision tooth profile, the internal teeth of the present internal gear can easily be machined in a desired precision because its tooth profile is simply straight, whereby a fluid apparatus with less wear of sliding parts, less noise, and good efficiency can relatively easily be manufactured.

I claim:

1. A fluid apparatus of an internal gear type, said apparatus comprising; an internally toothed gear rotatively mounted within a housing, an externally toothed gear disposed within said internally toothed gear so as to mesh therewith, and a crescent-shaped partition piece disposed within the housing between both gears, each tooth profile of said gears being defined by a line equidistant from an inner cycloid described by a rolling circle rolling along intermeshing pitch circles of said gears in an inscribed manner, the diameter of the rolling circle being equal to a radius of the intermeshing pitch circle of the internal gear.

* * * * *